US009810415B2

(12) United States Patent
Favarolo et al.

(10) Patent No.: US 9,810,415 B2
(45) Date of Patent: Nov. 7, 2017

(54) LIGHT-EMITTING ASSEMBLY AND LAMP HAVING A LIGHT-EMITTING ASSEMBLY

(71) Applicant: ZUMTOBEL LIGHTING GMBH, Dornbirn (AT)

(72) Inventors: Piere Angelo Favarolo, Wangen (DE); Stefan Kornhaas, Markdorf (DE)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 73 days.

(21) Appl. No.: 14/415,178

(22) PCT Filed: Jul. 15, 2013

(86) PCT No.: PCT/EP2013/064878
§ 371 (c)(1),
(2) Date: Jan. 16, 2015

(87) PCT Pub. No.: WO2014/012875
PCT Pub. Date: Jan. 23, 2014

(65) Prior Publication Data

US 2015/0176827 A1 Jun. 25, 2015

(30) Foreign Application Priority Data

Jul. 17, 2012 (DE) ..... 20 2012 102 644 U

(51) Int. Cl.
*F21V 13/04* (2006.01)
*F21V 29/00* (2015.01)
(Continued)

(52) U.S. Cl.
CPC ..... *F21V 29/15* (2015.01); *F21V 5/04* (2013.01); *F21V 13/04* (2013.01); *F21V 29/86* (2015.01); *F21Y 2115/10* (2016.08)

(58) Field of Classification Search
CPC ..... F21V 13/04; F21V 29/15; F21V 29/86; F21V 5/04; F21V 29/504; F21Y 2101/02
See application file for complete search history.

(56) References Cited

U.S. PATENT DOCUMENTS 3,120,352 A 2/1964 Tadayoshi et al.
3,255,342 A * 6/1966 Seitz ..... F21V 9/04 353/55
(Continued)

FOREIGN PATENT DOCUMENTS

DE 2032229 4/1971
DE 4305633 * 2/1993 ..... F21V 5/04
(Continued)

OTHER PUBLICATIONS

English Translation, DE 4305633, Feb. 24, 1193.*
(Continued)

*Primary Examiner* — Peggy Neils
(74) *Attorney, Agent, or Firm* — Brooks Kushman P.C.

(57) ABSTRACT

A light-emitting assembly that has a light-radiating element for radiating light, an optical element for influencing the light, and a transparent insulating element, which is arranged in the path of the light, wherein the insulating element is made of a material that is more thermally stable than the material of the optical element. A lamp, in particular in the form of a spotlight, having such a light-emitting assembly is also disclosed.

19 Claims, 5 Drawing Sheets

(51) Int. Cl.

| | |
|---|---|
| ***F21V 29/15*** | (2015.01) |
| ***F21V 29/85*** | (2015.01) |
| ***F21V 5/04*** | (2006.01) |
| *F21Y 115/10* | (2016.01) |

(56) References Cited

U.S. PATENT DOCUMENTS

| | | | | |
|---|---|---|---|---|
| 3,302,019 | A * | 1/1967 | Menzin | F21S 8/02 362/296.01 |
| 3,725,697 | A | 4/1973 | Wince | |
| 5,703,374 | A * | 12/1997 | Caprari | F21V 13/04 250/492.2 |
| 6,437,909 | B1 * | 8/2002 | Okamori | F21V 9/06 359/359 |
| 6,527,422 | B1 * | 3/2003 | Hutchison | F21S 48/328 362/290 |

FOREIGN PATENT DOCUMENTS

| | | |
|---|---|---|
| DE | 102008010029 | 8/2009 |
| DE | 202009012100 | 11/2009 |
| FR | 2687761 | 8/1993 |
| FR | 2898403 | 9/2007 |
| WO | 9964783 | 12/1999 |

OTHER PUBLICATIONS

International Search Report PCT/EP2013/064878, English translation attached to original, Both completed by the European Patent Office dated Oct. 11, 2013, All together 8 Pages.

* cited by examiner

LIGHT-EMITTING ASSEMBLY AND LAMP HAVING A LIGHT-EMITTING ASSEMBLY

CROSS-REFERENCE TO RELATED APPLICATIONS

This application is the U.S. national phase of PCT Application No. PCT/EP2013/064878 filed on Jul. 15, 2013, which claims priority to German Patent Application No. 20 2012 102 644.9 filed on Jul. 17, 2012, the disclosures of which are incorporated in their entirety by reference herein.

FIELD OF INVENTION

The invention relates to a light-emitting assembly having a light-emitting element and an optical element for influencing light. Furthermore, the invention relates to a lamp having such a light-emitting assembly.

BACKGROUND

In such a light-emitting assembly, it may arise that, in an undesired manner, a dust or dirt particle is deposited at a point on the surface of the optical element which is in the path of the light emitted by the light-emitting element. The light impinging on this particle is generally absorbed to a considerable extent by the particle, with the result that there is a local temperature increase which is then propagated to a greater or lesser extent by thermal conduction within the optical element. If the temperature exceeds the softening point or melting point of the material of which the optical element consists, deformation or fusing of the optical element takes place. If, owing to the heating, coloring of the optical element also takes place, a "chain reaction" can moreover occur since, in general, again more radiation or light is absorbed by such a coloration. The temperature increase in question can therefore result in damage to the optical element. Furthermore, under certain circumstances, further component parts of the light-emitting assembly may also be damaged and the light-emitting assembly may even be completely destroyed.

The outlined problem accordingly results in particular when the optical element consists of a material which has a correspondingly low thermal stability, i.e. in particular a comparatively low softening point or melting point or decomposition point. In practice, this is in particular the case when the optical element consists of plastic. The optical element may be, for example, a plastic lens or a diffusing film consisting of plastic. In this case, even very low levels of contamination can result in the described effect taking place.

FIG. 3 shows part of a correspondingly destroyed light-emitting assembly. The destroyed optical element 20, in this case in the form of a destroyed plastic lens, is shown. The plastic lens is surrounded by a reflector 30, which has likewise been damaged. The component parts have been damaged or destroyed by fusing or decomposition. As mentioned above, therefore, not only destruction of the optical element, in this case the plastic lens, but also damage to further components of the light-emitting assembly can take place.

To further demonstrate the effect, FIG. 4 shows part of a corresponding light-emitting assembly in which a point 22, which simulates or represents a corresponding dust particle, has been applied to the light entry surface 21 of the plastic lens, denoted by 20' here, with a felt tip pen. This assembly has been provided with a light-emitting element, in this case in the form of an LED (light-emitting diode) light source and has been operated for 2 hours with the light-emitting element emitting light. FIG. 5 shows the state after 2 hours: practically the entire light entry surface 21 is irregularly deformed and black as a result of the destruction.

SUMMARY

The invention is based on the object of specifying a corresponding light-emitting assembly and a lamp having a light-emitting assembly in which the risk of thermally induced damage is reduced.

This object is achieved according to the invention by the subjects mentioned in the independent claims. Particular embodiments of the invention are specified in the dependent claims.

In accordance with the invention, a light-emitting assembly is provided which has a light-emitting element for emitting a light, and an optical element for influencing the light. Furthermore, the light-emitting assembly has a transparent insulating element, which is arranged in the path of the light, wherein the insulating element consists of a material which is more thermally stable than that of the optical element.

Owing to the transparent insulating element, the probability of undesired particle deposits at or on the optical element can be markedly reduced or even virtually ruled out. If a particle is deposited on the insulating element on the side opposite the optical element, the corresponding heat produced by absorption is distributed within the insulating element by means of thermal conduction; in addition, by virtue of the insulating element itself, a thermal resistance between the particle and the optical element is formed. In this way, the probability of thermally induced damage to the optical element is significantly reduced.

Preferably, the insulating element is arranged in such a way that the light emitted by the light-emitting element first passes through the insulating element and then enters the optical element.

Preferably, the optical element consists of plastic. The insulating element preferably consists of glass.

A particularly space-saving configuration can be achieved if the insulating element has a plate-shaped or disk-shaped configuration. In addition, it is hereby possible to achieve a situation whereby the light is influenced to a particularly small degree as it passes through the insulating element.

A particularly high level of thermal resistance towards the optical element can be achieved if the light-emitting assembly is configured in such a way that an air-filled space is formed between the optical element and the insulating element. By virtue of such an air space or air gap, the heating of the optical element can be reduced to a greater extent. In this case, the insulating element effects distribution of the heat by thermal conduction, and the air-filled space contributes to the formation of a particularly high thermal resistance.

Preferably, the insulating element is formed so as to consist of one piece. In this way, a particularly simple configuration can be achieved. In addition, this makes it possible for the light to be weakened or deflected to a particularly small extent by the insulating element, with the result that the efficiency of the light-emitting assembly is impaired to a particularly small extent.

Preferably, the insulating element is configured and arranged in such a way that it bounds a light entry surface for the entry of the light into the optical element. In this way, the possibility of a particle being deposited on the light entry surface of the optical element can be practically prevented.

Alternatively, provision can be made for the light-emitting assembly to furthermore have a surrounding element which is arranged so as to surround both the optical element and the insulating element, in particular in dust-tight fashion. In particular, the air-filled space can be formed so as to be bounded by the optical element, the insulating element and the surrounding element. In this way, too, it is possible to practically rule out the possibility of a particle being deposited on the light entry surface of the optical element.

Preferably, the surrounding element is configured and arranged in such a way that it bounds a light entry surface for the entry of the light into the optical element. As a result, a particularly simple configuration of the light-emitting assembly is made possible.

A particularly simple possible configuration also results when the light-emitting element is arranged so as to be held directly or indirectly on the surrounding element.

Preferably, the surrounding element consists of a non-transparent material, for example of plastic or a metal. In this way, the possibility is provided of a particularly small amount of light escaping from the light-emitting assembly on the path of light between the insulating element and the optical element, with the result that the efficiency of the light-emitting assembly is increased.

Preferably, the surrounding element is a reflector element. As a result, the number of component parts in the light-emitting assembly can be kept particularly small.

Preferably, the surrounding element is formed so as to consist of one piece. This also results in the number of component parts being kept low. Alternatively, the surrounding element can be formed so as to consist of a plurality of individual parts. As a result, under certain circumstances, particularly simple assembly of the light-emitting assembly can be made possible.

In accordance with a further aspect of the invention, a lamp is provided, in particular in the form of a projector lamp, which has a light-emitting assembly according to the invention.

The invention will be explained in more detail below using an exemplary embodiment and with reference to the drawings, in which:

DETAILED DESCRIPTION

Figure 1:
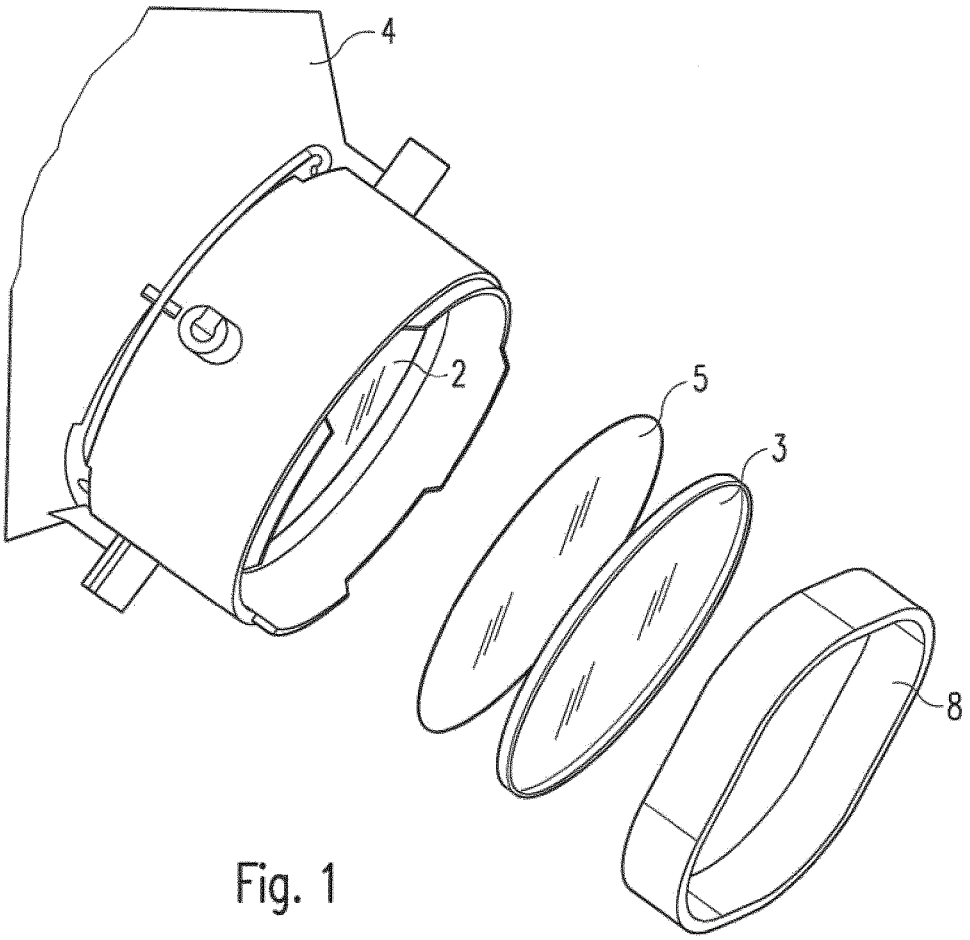
FIG. 1 shows a perspective sketch in the form of an exploded illustration of component parts of a light-emitting assembly according to the invention.
Figure 2:
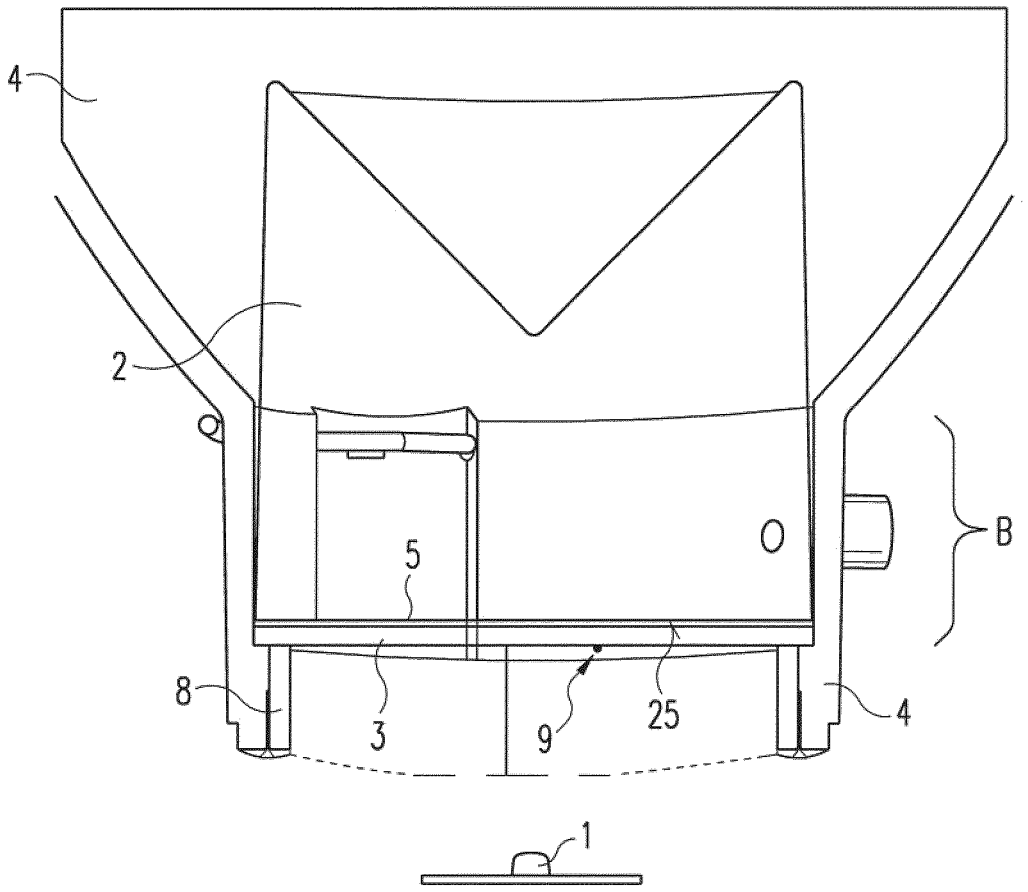
FIG. 2 shows a corresponding cross-sectional sketch.

In FIG. 1, component parts of a light-emitting assembly according to the invention are sketched in the form of an exploded illustration, and FIG. 2 shows a corresponding cross-sectional illustration. The light-emitting assembly comprises a light-emitting element 1 for emitting a light. In FIG. 2, the light-emitting element 1 is indicated purely schematically. In particular, the light-emitting element 1 may be an LED light source, i.e., for example, a printed circuit board on which an LED is arranged or a plurality of LEDs are arranged.

Furthermore, the light-emitting assembly comprises an optical element 2 for influencing the light emitted by the light-emitting element 1. In particular, the optical element 2 consists of a plastic. The optical element 2 may be, for example, a lens.

Preferably, the optical element 2 has a light entry surface 25, which is configured to allow the entry of the light emitted by the light-emitting element 1. As is the case in the example shown, the light entry surface 25 can be formed by a surface region of the optical element 2 which faces the light-emitting element 1.

Furthermore, the light-emitting assembly comprises a transparent insulating element 3. In this case, the insulating element 3 is arranged in the path of the light and consists of a material which is more thermally stable than the material of which the optical element 2 consists. In particular, the configuration is such that the insulating element 3 is arranged in such a way that the light emitted by the light-emitting element 1 first passes through the insulating element 3 and then enters the optical element 2.

Preferably, the insulating element 3 consists of glass. Glass is more thermally stable than plastic.

As sketched by way of example in the figures, the insulating element 3 preferably has a plate-shaped or disk-shaped configuration. In addition, it preferably consists of only one piece. In this way, the passage of light through said insulating element is impaired to a particularly low extent.

By virtue of the insulating element 3, it is possible to form an "interlayer" which is comparatively thermally stable between the thermally more susceptible optical element 2, on the one hand, and a particle 9, which may be present, on the other hand. Owing to the transparency of the insulating element 3, it is in this case possible to achieve a situation whereby, as a result, the optical properties of the light-emitting assembly, in particular the lighting efficiency thereof, are not notably impaired. The interlayer or the insulating element 3 so to speak distributes the heat which forms in the case of the deposited particle 9 as light enters as a result of absorption by means of thermal conduction and represents a thermal resistance between the particle 9 and the optical element 2. As a result, the temperature of the optical element 2 is kept correspondingly low.

If the thermal conductivity of the insulating element 3 is directionally independent or isotropic and is comparatively high, the heat is distributed very well, but the thermal resistance formed perpendicular to the insulating element 3 by the insulating element 3 is comparatively low. If, on the other hand, the thermal conductivity of the insulating element 3 is comparatively low, the thermal resistance between the particle 9 and the optical element 2 is comparatively high, but the heat is not distributed as well. This effect can be effectively counteracted if the light-emitting assembly is configured in such a way that an air-filled space or an air layer is formed between the insulating element 3 and the optical element 2 (not shown in the figures). In this case, the heat is distributed well within the insulating material 3, but the thermal resistance between the particle 9 and the optical element 2 is nevertheless particularly high owing to the air layer. The spacing between the optical element 2 or the light entry surface 25 of the optical element 2, on the one hand, and the insulating element 3, on the other hand, is preferably at least 1 mm, particularly preferably at least 2 mm.

Figure 3:
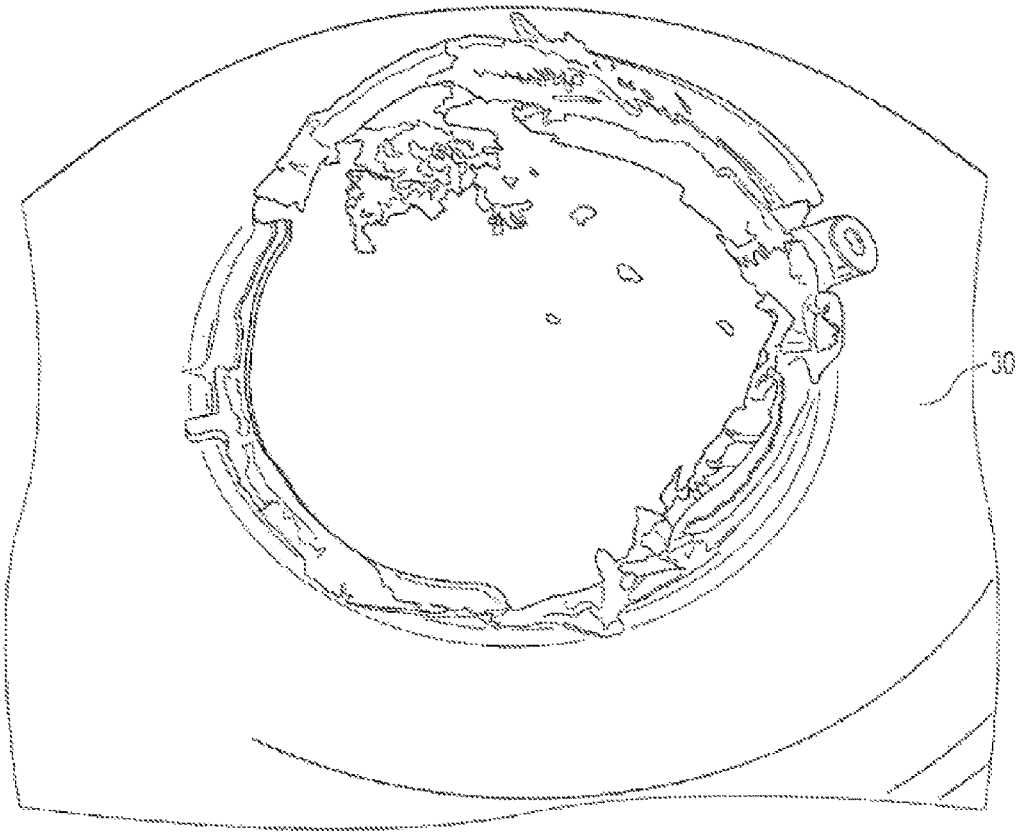
Fig. 3 Prior Art
FIGS. 3 to 5 show illustrations of the damage to known light-emitting assemblies.
Figure 4:
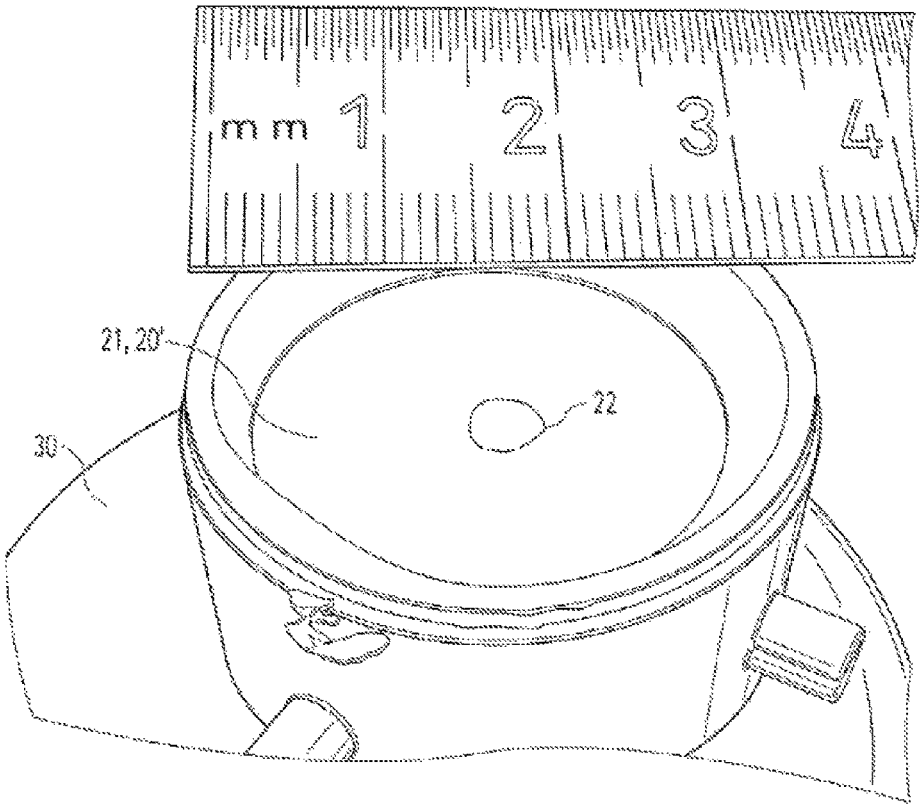
Fig. 4 Prior Art
Figure 5:
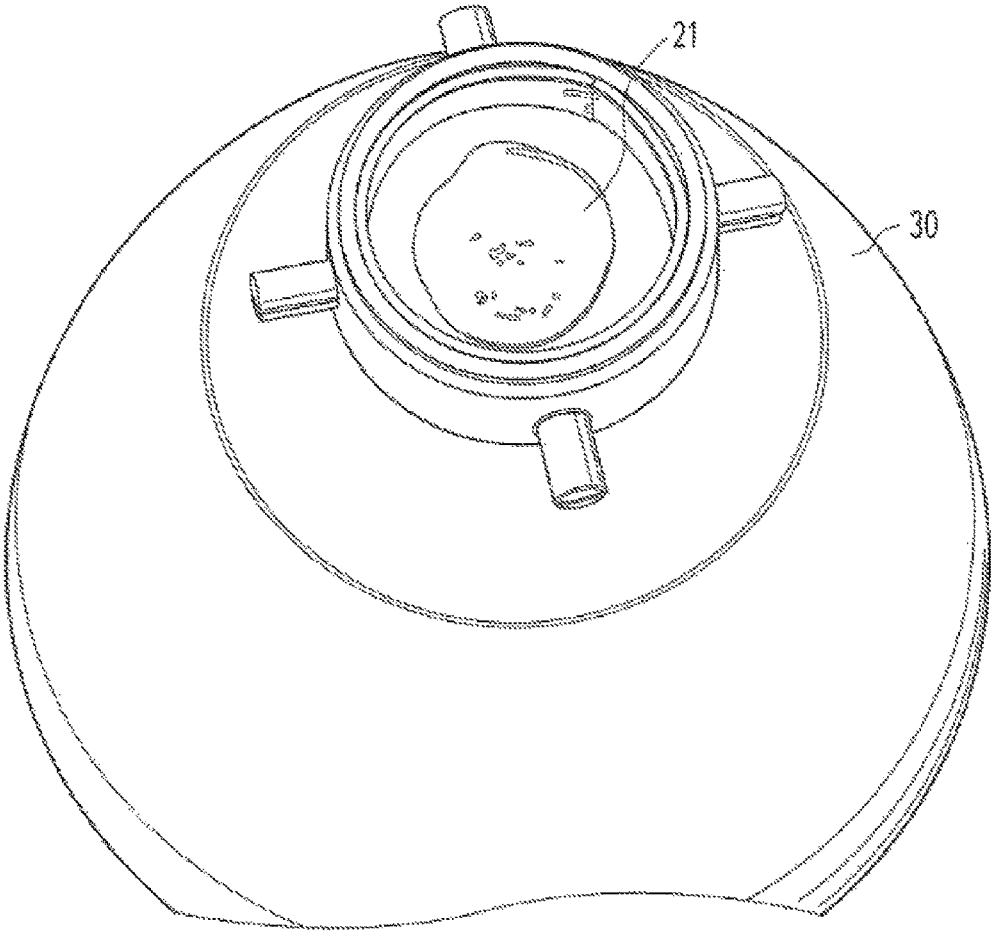
Fig. 5 Prior Art

In the example sketched in FIGS. 2 and 3, the light-emitting assembly also comprises a diffusing disk 5, which is arranged between the optical element 2 and the insulating element 3. The diffusing disk 5 can consist of plastic. In this case, the diffusing disk 5 itself represents an optical element which is protected in an analogous manner by the insulating element 3.

As is furthermore the case in the example illustrated, the light-emitting assembly preferably also has a surrounding element 4, which is formed and arranged in such a way that it surrounds both the optical element 2 and the insulating element 3, in particular in dust-tight fashion. In this way, the possibility of a particle being deposited in an undesired manner on the light entry surface 25 can be practically prevented.

For example, the configuration can be such that, as indicated in FIG. 2, the surrounding element 4 has a hollow-cylindrical region B and the optical element 2 has a cylindrical outer surface, with which it makes contact with the hollow-cylindrical region B, and the insulating element 3 likewise has a cylindrical outer surface with which it makes contact with the hollow-cylindrical region B of the surrounding element 3. Preferably, the shape is in each case circular-cylindrical.

In this case, the surrounding element 4 can be configured and arranged in such a way that it bounds the light entry surface 25 of the optical element 2.

Preferably, the configuration is furthermore such that the light-emitting element 1 is arranged so as to be held directly or indirectly on the surrounding element 4.

Preferably, the surrounding element 4 consists of a non-transparent material, for example of plastic or a metal. As is the case in the example shown, the surrounding element may be a reflector element, which is preferably furthermore configured to influence the light, in particular the light that has emerged from the optical element 2 again.

The surrounding element 4 can be formed from one piece, as sketched, but it is also possible for it to consist of a plurality of pieces.

In the exemplary embodiment shown, the light-emitting assembly also has a ring-shaped reflector element 8, for example in the form of a reflector film, which is arranged on that side of the insulating element 3 which is opposite the optical element 2.

Particularly preferably, the light-emitting assembly forms a component part of a lamp, in particular a projector lamp. In particular, the lamp can be designed for a downward light emission.

The invention claimed is:

1. A light-emitting assembly, having;

a light-emitting element for emitting a light along a path, an optical element for influencing the path of the light, and a transparent insulating element, which is arranged in the path of the light between the light-emitting element and the optical element, wherein the insulating element comprises a material which is more thermally stable than that of the optical element, and a surrounding element which is arranged so as to surround both the optical element and the insulating element in dust-tight fashion, wherein the surrounding element has a hollow-cylindrical region and the optical element has a cylindrical outer surface which contacts the hollow-cylindrical region, and the insulating element has a cylindrical outer surface which contacts the hollow-cylindrical region of the surrounding element.

2. The light-emitting assembly as claimed in claim 1, wherein the optical element and the insulating element are spaced at least 2 mm apart.

3. The light-emitting assembly as claimed in claim 1, in which the surrounding element consists of plastic.

4. The light-emitting assembly as claimed in claim 1, in which the surrounding element is formed of one piece.

5. The light-emitting assembly as claimed in claim 1, in which the insulating element has a plate-shaped or disk-shaped configuration.

6. The light-emitting assembly as claimed in claim 1, in which an air-filled space is formed between the optical element and the insulating element.

7. The light-emitting assembly as claimed in claim 1, in which the insulating element is formed so as to consist of one piece.

8. The light-emitting assembly as claimed in claim 1, in which the insulating element is configured and arranged in such a way that it bounds a light entry surface for the entry of the light into the optical element.

9. The light-emitting assembly as claimed in claim 1, further having a light diffusing disk, which is arranged in the path of light between the optical element and the insulating element.

10. The light-emitting assembly as claimed in claim 9, in which the surrounding element is configured and arranged in such a way that it bounds a light entry surface for the entry of the light into the optical element.

11. The light-emitting assembly as claimed in claim 9, in which the light-emitting element is arranged so as to be held directly on the surrounding element.

12. The light-emitting assembly as claimed in claim 9, in which the surrounding element consists of a non-transparent material.

13. The light-emitting assembly as claimed in claim 9, in which the surrounding element forms a reflector element.

14. The light-emitting assembly as claimed in claim 9, in which the surrounding element is formed so as to consist of one piece.

15. A projector lamp, comprising a light-emitting assembly as claimed in claim 9.

16. The light-emitting assembly as claimed in claim 1, wherein the insulating element is formed of glass.

17. The light-emitting assembly as claimed in claim 16, wherein the optical element consists of plastic.

18. The light-emitting assembly as claimed in claim 1, wherein the optical element consists of plastic.

19. The light-emitting assembly as claimed in claim 9, wherein the light diffusing disk consists of plastic.

* * * * *